US005934410A

United States Patent [19]

Mahr

[11] Patent Number: 5,934,410

[45] Date of Patent: Aug. 10, 1999

[54] TREE CLIMBING AID

[76] Inventor: Lawrence John Mahr, 3721 Middleboro Rd., Castle Shannon, Pa. 15234

[21] Appl. No.: 09/027,498

[22] Filed: Feb. 20, 1998

[51] Int. Cl.[6] ..... A63B 27/00

[52] U.S. Cl. ..... 182/221; 182/134

[58] Field of Search ..... 182/221, 134, 182/116, 115, 187, 188; 248/218.4

[56] References Cited

U.S. PATENT DOCUMENTS

| | | | |
|---|---|---|---|
| 237,275 | 2/1881 | Hill | 182/221 |
| 4,592,446 | 6/1986 | White | 182/116 X |
| 4,679,658 | 7/1987 | Demers | 182/221 |
| 5,249,644 | 10/1993 | Amacker | 182/134 |
| 5,277,273 | 1/1994 | Grimes | 182/187 |
| 5,285,868 | 2/1994 | Amacker | 182/134 |
| 5,341,896 | 8/1994 | Amacker | 182/9 |
| 5,417,306 | 5/1995 | Robl | 182/134 |
| 5,593,121 | 1/1997 | Tackett | 248/218.4 |

*Primary Examiner*—Daniel P. Stodola
*Assistant Examiner*—Hugh B. Thompson
*Attorney, Agent, or Firm*—William L. Krayer

[57] ABSTRACT

Apparatus for climbing trees and poles includes two stirrups having downward oriented hooks on the sides thereof, ankle straps thereon, and a plurality of spanning straps for tightening around a tree r pole. The apparatus permits ready ascent through tree branches oriented in all directions, and is easily portable. Hunters, for example, may wear the stirrups while walking through the woods.

9 Claims, 3 Drawing Sheets

TREE CLIMBING AID

TECHNICAL FIELD

This invention relates to portable devices for assisting hunters and others in climbing trees or poles.

BACKGROUND OF THE INVENTION

Hunters have a need for portable apparatus for use in climbing trees, and to serve as support after climbing some distance up a tree. Whatever apparatus is used, it should not damage the tree, as many states and localities have outlawed the use of such equipment. It is also desirable that the hunter should be able to rotate around the tree in order to avoid branches, which seldom leave room for a straight ascent.

The present inventor is aware of certain approaches to the problem in the prior art. Grimes, for example, in U.S. Pat. No. 5,277,273, shows an elongated ladder-like device which is held to the tree by straps. A "hunter's ladder", held to the tree by a rope, is also described by Prejean in U.S. Pat. No. 5,509,499. The tree-climbing stand of Amacker in U.S. Pat. No. 5,285,868 employs two foot platforms pivoted to a hooked member which clings to the back of the tree while supporting the foot platform, in a manner similar to Robl in U.S. Pat. No. 5,417,306. Robl uses a strap around the hunter's waist for stability. A strap or harness is also used by Amaker in U.S. Pat. No. 5,341,896.

Many of these solutions and others of which I am aware are quite cumbersome, difficult to carry, and awkward to place on the tree and use. Moreover, many do not satisfy all l the criteria suggested in the first paragraph above. Accordingly, there is a need for a convenient portable device for assisting in tree and pole climbing.

SUMMARY OF THE INVENTION

My invention comprises a plurality of straps for tightening around a tree or pole, and two foot inserts having a hook designed to place on a strap after it is tightened around the tree. My apparatus may be worn through the woods so it is instantly ready for ascending a tree. And, it can be used with an optional safety belt for securing the upper body to the tree.

DETAILED DESCRIPTION OF THE DRAWINGS

Figure 1A:
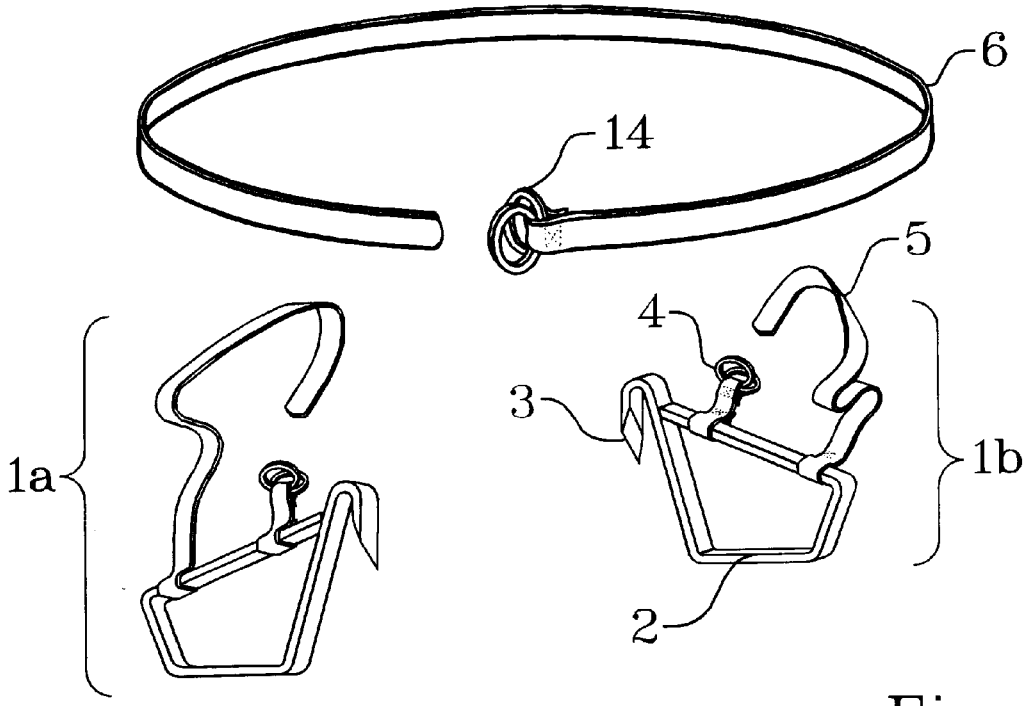
FIG. 1*a* and 1*b* show the foot insert and strap from which it is suspended in use.
Figure 1B:
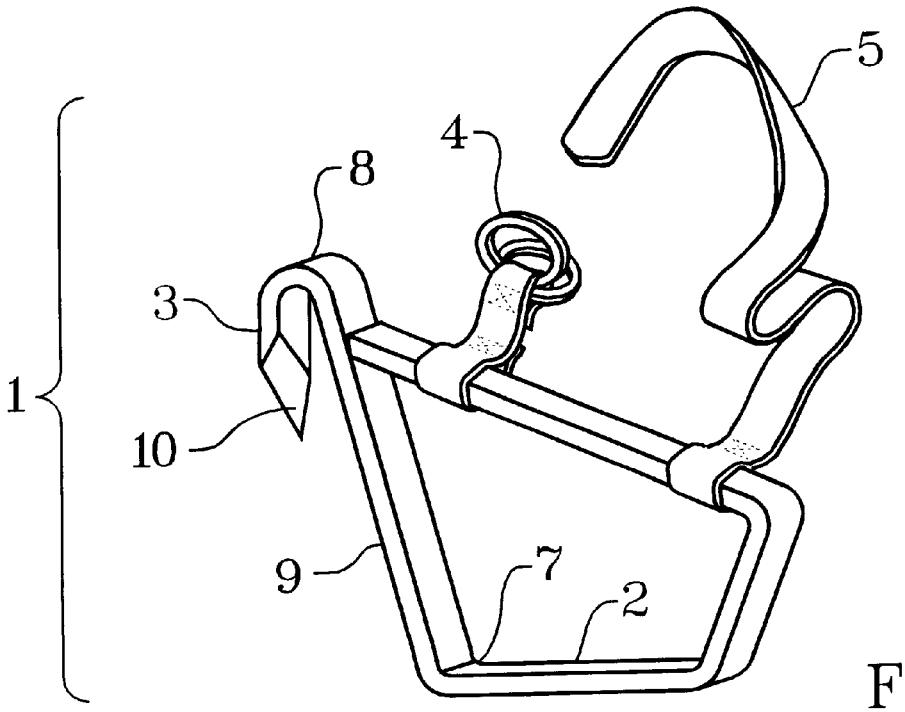

Referring now to FIGS. 1*a* and 1*b*, the foot inserts 1, 1*a* and 1*b* in the form of stirrups are seen to have a relatively flat foot support 2 as part of a steel bar 9 which has been bent to form approximately a 90° corner at 7 and otherwise shaped as shown, for example at hook 8. Hook 8 leads to blade 3 having a terminus 10 for insertion between a strap and the tree, as will be seen in FIG. 2. Attached to the top of the foot insert 1 is ankle belt 5 which may be tightened in rings 4 in a known manner. Spanner strap 6 is shown to be a simple leather or, preferably, flexible synthetic strap or belt having a simple clasping means such as rings 14.

Figure 2:
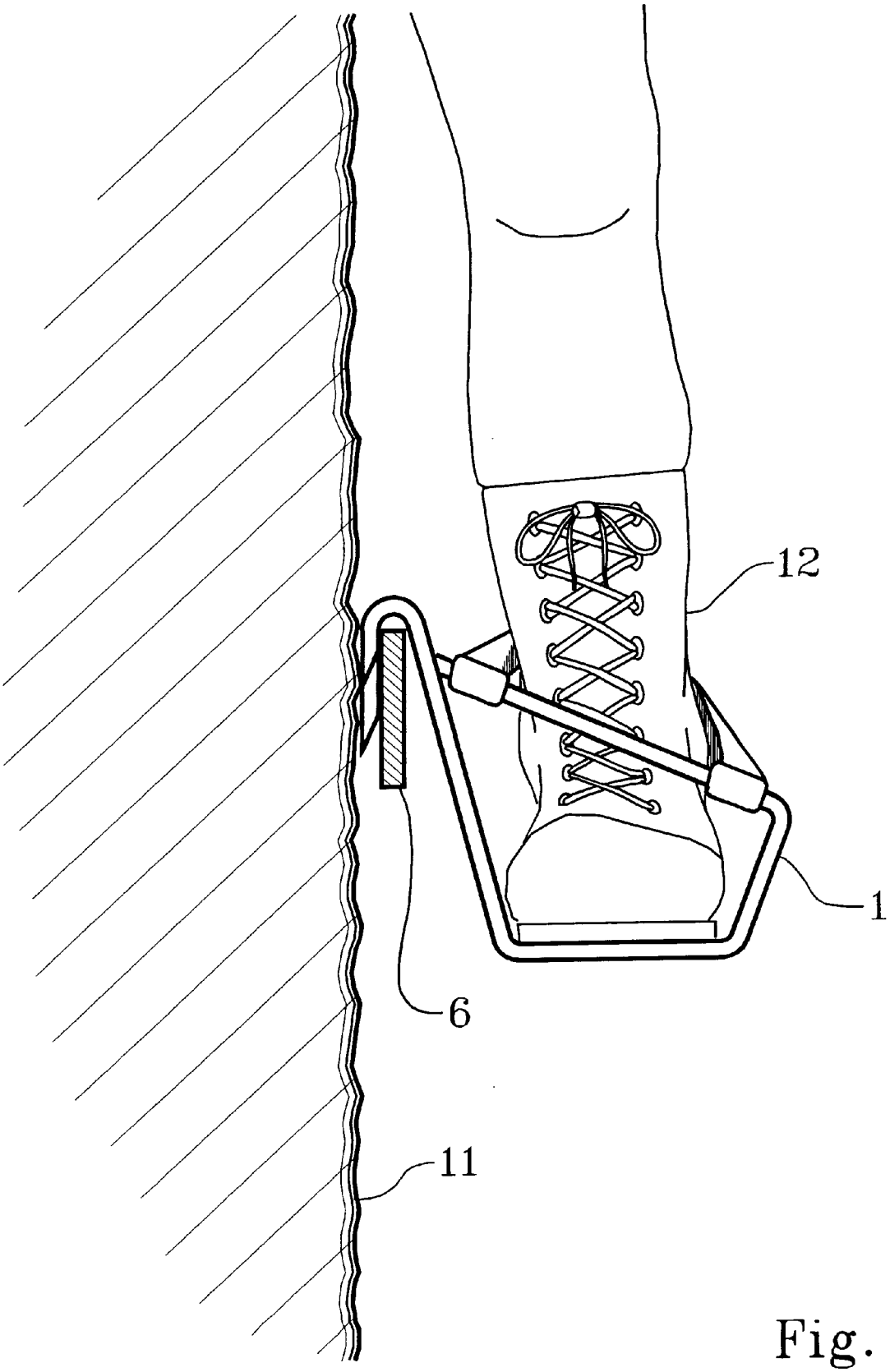
FIG. 2 shows a foot in place in the foot insert suspended on a strap, which is shown in section in place on a tree.

In FIG. 2, the user's boot 12 is in the foot insert 1. The user has just inserted hook 8 between spanner strap 6 and pole 11. Spanner strap 6 encircles pole 11 but is shown only in section in this view. As the user places his weight on foot insert 1, it will tend to incline toward pole 11.

Figure 3:
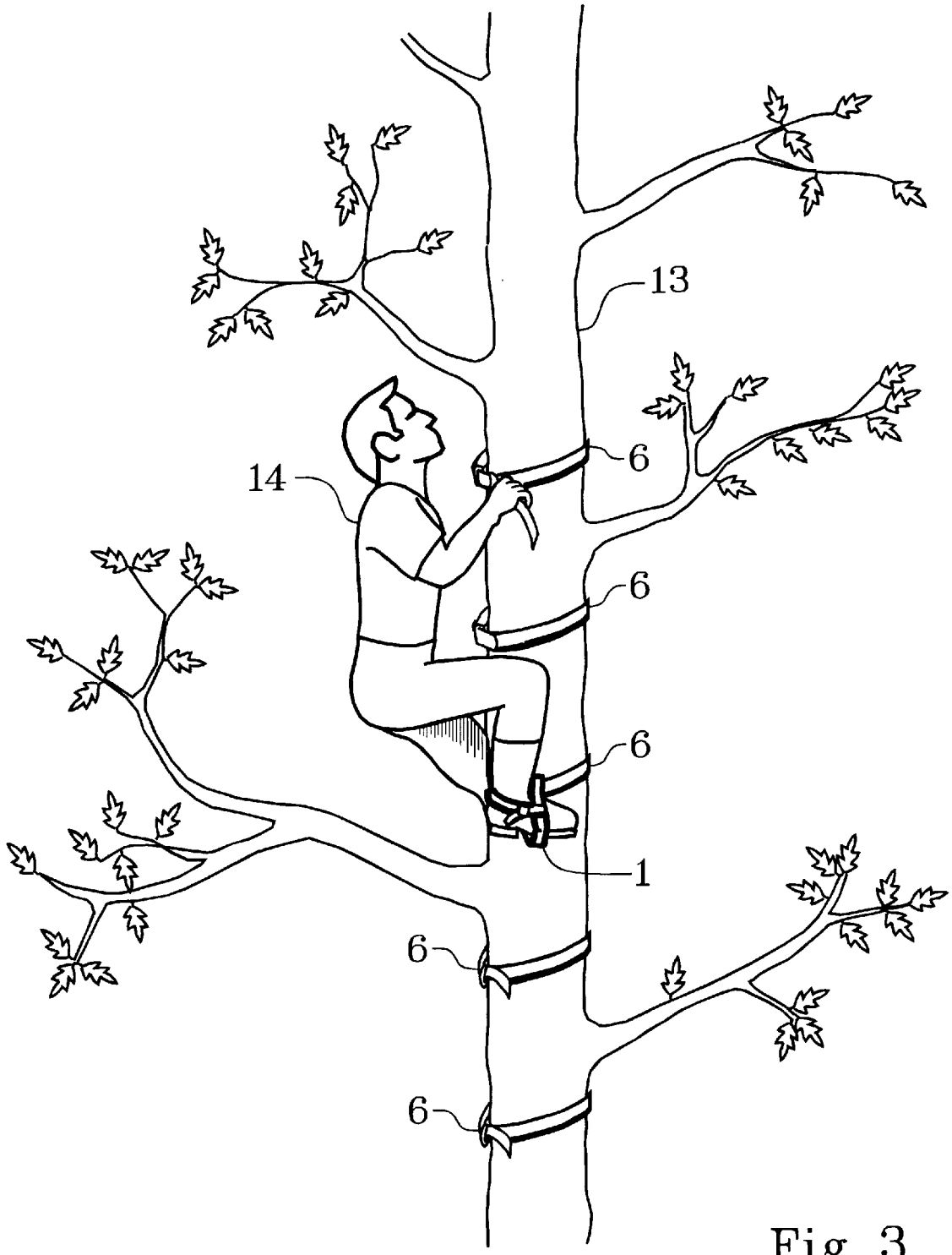
FIG. 3 shows a typical use of the apparatus, in which several straps are left behind on the tree for the descent.

It will be seen in FIG. 3 that the user has placed several spanner straps 6 at various levels on the tree 13.

Use of the invention is thus seen to be quite simple and convenient. One takes as many spanner straps 6 as he thinks he may want or need for the purpose, together with two of the foot inserts 1 and, preferably, also a safety harness for his upper body. Note that one may attach a simple clasp leading from a harness to the spanner strap 6 nearest the chest or stomach. The user secures the his feet to the foot inserts 1 using the ankle belts 5. The spanner straps 6 are secured to the tree as the user ascends, and the hooks 8, located on the sides of the stirrup-like foot inserts 1, are alternately slipped between the spanner straps 6 and the tree 13 so that the foot inserts 1 may support the user by friction and the fact that the weight of the user is on one side of the spanner strap 6 rather than being evenly distributed.

Thus my invention includes two stirrups having downward-oriented hooks on the sides thereof and ankle straps therefor, and a plurality of spanner straps including means for securing and tightening around a pole or tree.

I claim:

1. Climbing apparatus comprising a plurality of spanning straps including means for tightening around a tree or pole, two stirrips having means on the sides thereof for attaching to said straps to be supported thereby when said straps are tightened around a tree or pole, and ankle straps attached to said stirrups for securing a foot into each of said stirrups.

2. Climbing apparatus of claim 1 wherein said ankle straps each includes a pair of rings on one end for tightening said ankle straps.

3. Climbing apparatus of claim 1 wherein said spanning straps each includes a pair of rings on one end for tightening said spanning straps.

4. Climbing apparatus of claim 1 wherein said means for attaching to said straps is a hook.

5. Climbing apparatus of claim 1 wherein said stirrups and said hooks form an integral member.

6. Apparatus for supporting a person climbing a tree or pole comprising a strap tightened around said tree or pole, a stirrup for supporting the foot of said person, and means for supporting said stirrup by said strap.

7. Apparatus of claim 6 wherein said means for supporting said stirrup is a hook on said stirrup.

8. Apparatus of claim 6 wherein said strap is tightened around said tree or pole through metal rings thereon.

9. Apparatus of claim 6 wherein said stirrup includes ankle straps for securing said stirrup to said person.

* * * * *